United States Patent [19]

Kozawa et al.

[11] Patent Number: 4,854,830

[45] Date of Patent: Aug. 8, 1989

[54] MOTOR-DRIVEN FUEL PUMP

[75] Inventors: Tadashi Kozawa; Naohiro Natsume; Hirofumi Komatsubara; Yasunori Takaku; Kiyoshi Kato; Seiichi Harada, all of Obu, Japan

[73] Assignee: Aisan Kogyo Kabushiki Kaisha, Obu, Japan

[21] Appl. No.: 187,516

[22] Filed: Apr. 28, 1988

[30] Foreign Application Priority Data

May 1, 1987 [JP] Japan ..... 62-67272
May 16, 1987 [JP] Japan ..... 62-73155
May 26, 1987 [JP] Japan ..... 62-79502

[51] Int. Cl.[4] ..... F04B 39/00

[52] U.S. Cl. ..... 417/365; 417/423.1; 417/423.3; 417/423.12; 415/55.1

[58] Field of Search ..... 417/365, 366, 423.1, 417/423.3, 423.5, 423.12, 423.13, 423.14, 424.1; 415/53 T, 53 R, 52, 213 T

[56] References Cited

U.S. PATENT DOCUMENTS 2,700,343 1/1955 Pezzillo, Jr. ..... 417/365 X
4,445,821 5/1984 Watanabe et al. ..... 417/423.12 X
4,449,891 5/1984 Kemmner ..... 417/423.12
4,451,213 5/1984 Takei et al. ..... 417/423.3 X
4,492,515 1/1985 Watanabe et al. ..... 415/423 T X
4,556,363 12/1985 Watanabe et al. ..... 415/213 T X
4,586,877 5/1986 Watanabe ..... 417/423.3 X
4,784,587 11/1988 Takei et al. ..... 417/423.1 X

FOREIGN PATENT DOCUMENTS 0224168 4/1959 Australia ..... 415/213 T
58-151397 10/1983 Japan .

*Primary Examiner*—Carlton R. Croyle
*Assistant Examiner*—Eugene L. Szczecina, Jr.
*Attorney, Agent, or Firm*—Dennison, Meserole, Pollack & Scheiner

[57] ABSTRACT

A motor-driven fuel pump including a motor section provided with a driving motor, and a pump section arranged below the motor section and provided with an impeller to be driven by the driving motor. A plurality of pressure compensation hollows are formed on opposite surfaces of a sealing portion of the impeller, and a plurality of communication holes are formed through the sealing portion for communicating the pressure compensation hollows. In another aspect, a plurality of pressure compensation passages are provided to be communicated to a higher pressure side of either a pump chamber defined around outer peripheral vanes of the impeller and a fuel well for receiving a fuel leaked along a sealing portion of the impeller.

1 Claim, 10 Drawing Sheets

MOTOR-DRIVEN FUEL PUMP

BACKGROUND OF THE INVENTION

The present invention relates to an in-tank motor-driven fuel pump adapted to be mounted in a fuel tank for an automobile or the like, and more particularly to a motordriven fuel pump improved in discharge efficiency.

FIG. 27 shows a conventional in-tank motor-driven fuel pump for an automobile or the like similar to a pump as disclosed in Japanese Utility Model Laid-Open Publication No. 58-151397. Referring to FIG. 27, reference numeral 8 generally designates a motor-driven fuel pump mounted in a fuel tank 2 and vertically supported by a bracket 4. The motor-driven fuel pump 8 is generally composed of a pump section and a motor section which are formed in a cylindrical housing 10. The pump section is located in a lower portion of the housing 10, while the motor section is located in an upper portion of the housing 10. The pump section is partitioned by a partition wall 14 from the motor section. An end plate 28 is fixedly engaged at a lower end of the housing 10. There is defined a space between the partition wall 14 and the end plate 28 for engaging therein an annular upper spacer 20, a disc-like intermediate plate 46 having a central hole, and an annular lower spacer 26. An upper impeller or a second-stage impeller 52 is rotatably received in an upper space defined by the partition wall 14, the upper spacer 20 and the intermediate plate 46. A lower impeller or a first-stage impeller 40 is rotatably received in a lower space defined by the intermediate plate 46, the lower spacer 26 and the end plate 28. The second-stage and first-stage impellers 52 and 40 are formed at their outer peripheries with a plurality of radial vanes 48 and 44, respectively, for effecting a pumping function. At a lower surface of the partition wall 14, both surfaces of the intermediate plate 46 and an upper surface of the end plate 28, there are provided annular grooves facing the radial vanes 44 and 48. First-stage annular pump chamber 30 is formed around the radial vanes 44, and second-stage annular pump chamber 18 is formed around the radial vanes 48. The end plate 28, the intermediate plate 46 and the partition wall 14 are formed with a fuel inlet 42, a communication passage 22 and a pump outlet 50, respectively, at such positions as to face the first-stage and second-stage pump chambers 30 and 18. The impellers 40 and 52 are axially slidably mounted at their central portions to a motor shaft 58 projecting downwardly through the partition wall 14 from an armature 56 of the motor section which has magnets 54, and are driven to be rotated by the motor section.

When the motor section is operated, the impellers 40 and 52 are rotated to suck the fuel in the fuel tank 2 from the fuel inlet 42. The fuel sucked is boosted in the first-stage and second-stage pump chambers 30 and 18, and is fed through the pump outlet 50 into a motor chamber 12. The fuel in the motor chamber 12 is then discharged from a fuel discharge outlet 6.

In the motor-driven fuel pump as mentioned above, there are formed a sealing portion 16 between the partition wall 14 and the second-stage impeller 52, a sealing portion 24 between the second-stage impeller 52 and the intermediate plate 46, a sealing portion 32 between the intermediate plate 46 and the first-stage impeller 40 and a sealing portion 34 between the first-stage impeller 40 and the end plate 28. There are defined clearances in the sealing portions 16, 24, 32 and 34 to cause a fuel leakage loss. That is, the fuel leaks through the clearances of the sealing portions 16, 24, 32 and 34 between the pump chambers 18, 30 and a fuel well 36 through communication holes 38. To prevent a reduction in pump discharge efficiency due to the leakage loss, the clearances are made greatly small. Accordingly, if the dimensional accuracy of the sealing portions 16, 24, 32 and 34 is low and the impellers 40 and 52 have small unbalance, the impellers 40 and 52 under rotation generate an increased frictional resistance at the sealing portions 16, 24, 32 and 34. As a result, the rotation of the motor is reduced to cause a reduction in discharge efficiency of the motor-driven fuel pump 8.

SUMMARY OF THE INVENTION

It is an object of the present invention to provide a motor-driven fuel pump which reduces the frictional resistance of the impeller to thereby improve the discharge efficiency.

According to a first aspect of the present invention, there is provided in a motor-driven fuel pump including a motor section provided with a driving motor, and a pump section arranged below the motor section and provided with an impeller to be driven by the driving motor, the improvement comprising a plurality of pressure compensation hollows formed on opposite surfaces in a sealing portion of the impeller, and a plurality of communication holes for communicating the pressure compensation hollows.

With this arrangement, a pressure differential of the fuel between the opposite surfaces in the sealing portion of the impeller is cancelled by the communication holes, and the impeller is maintained in a balanced position by the fuel pressure in the pressure compensation hollows. Furthermore, the fuel in the pressure compensation hollows serves to lubricate the impeller, thereby greatly reducing the frictional resistance of the impeller.

According to a second aspect of the present invention, there is provided in a motor-driven fuel pump including a motor section provided with a driving motor, a pump section arranged below the motor section and provided with an impeller to be driven by the driving motor, a pump chamber defined around outer peripheral vanes of the impeller, and a fuel well for receiving a fuel leaked along a sealing portion of the impeller; the improvement comprising a plurality of pressure compensation passages formed on opposite surfaces in the sealing portion of the impeller and communicated to a higher pressure side of either the pump chamber or the fuel well.

With this arrangement, the fuel under high pressure in the pump chamber or the fuel well is induced to the pressure compensation passages, and the impeller is maintained in a balanced condition by the pressure of the fuel in the passages. Furthermore, the fuel in the passages serves to lubricate the impeller, thereby greatly reducing the frictional resistance of the impeller.

According to a third aspect of the present invention, there is provided in a motor-driven fuel pump including a motor section provided with a driving motor, a pump section arranged below the motor section and provided with an impeller to be driven by the driving motor, a pump chamber defined around outer peripheral vanes of the impeller, and a fuel well for receiving a fuel leaked along a sealing portion of the impeller; the improvement comprising clearances defined on opposite surfaces in the sealing portion of the impeller which clearances have a radially sectional shape diverging toward a higher pressure side of either the pump chamber or the fuel well.

With this arrangement, the fuel under high pressure in the pump chamber or the fuel well is induced to the clearances in the sealing portion, and the impeller is maintained in a balanced condition by the pressure of the fuel in the clearances. Furthermore, the fuel in the clearances serves to lubricate the impeller, thereby greatly reducing the frictional resistance of the impeller.

The invention will be more fully understood from the following detailed description and appended claims when taken with the drawings.

DETAILED DESCRIPTION OF THE PREFERRED EMBODIMENTS

Figure 1:
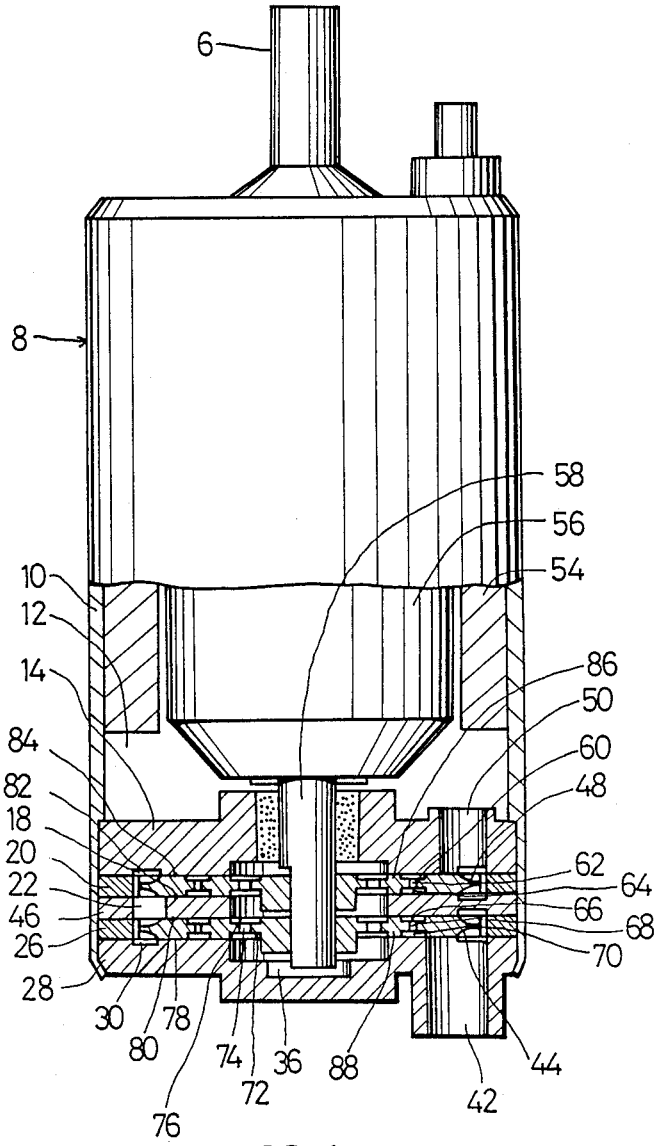
FIG. 1 is an elevational view, partly in section, of the motor-driven fuel pump according to the present invention.
Figure 2:
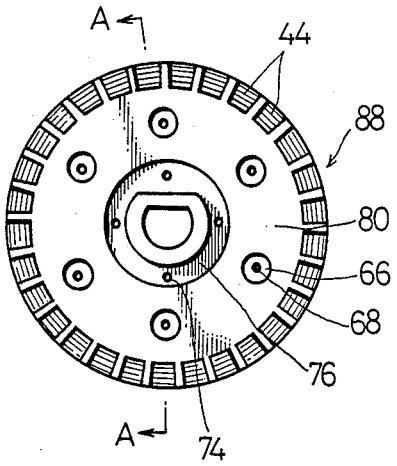
FIG. 2 is a plan view of a first preferred embodiment of the impeller shown in FIG. 1.
Figure 3:
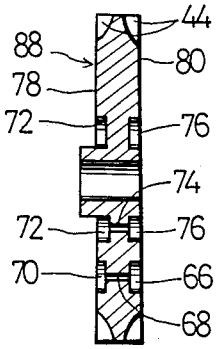
FIG. 3 is a cross section taken along the line A—A in FIG. 2.
Figure 27:
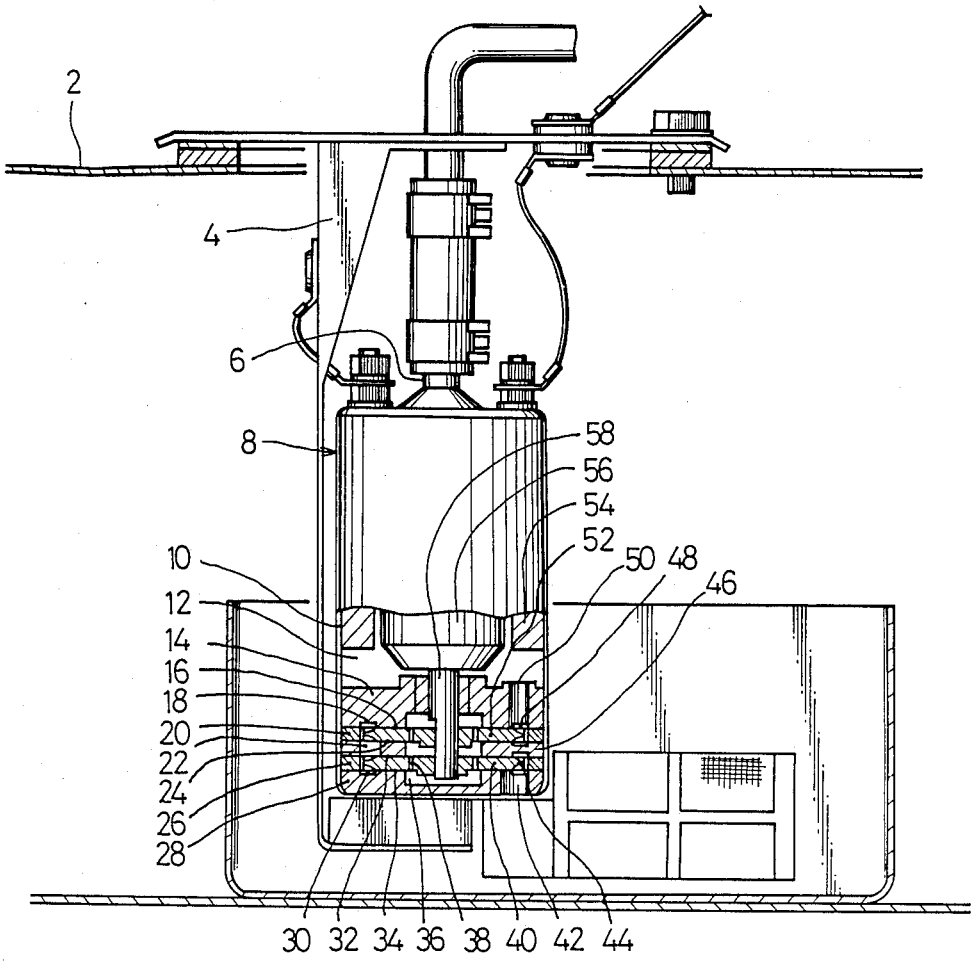
FIG.27 PRIOR ART
FIG. 27 is an elevational view, partly in section, of the motor-driven fuel pump in the prior art.

Referring to FIGS. 1 to 3 which show a first preferred embodiment of the present invention, wherein the parts corresponding to those in FIG. 27 are designated by the same reference numerals, the motor-driven fuel pump 8 is of a two-stage pump type having a first-stage impeller 88 and a second-stage impeller 86. The first and second impellers 88 and 86 have the same structure in this embodiment and the following description is directed to the first impeller 88 only. The impeller 88 has a plurality of vanes 44 at the outer periphery, a pair of sealing portions 78 and 80 each having a fixed width formed on the opposite surfaces of the impeller 88 inside the vanes 44, and a pair of annular central grooves 72 and 76 formed around the boss of the impeller 88 for inserting the motor shaft 58 on the opposite surfaces of the impeller 88 inside the sealing portions 78 and 80. The annular central grooves 72 and 76 are communicated through a plurality of communication holes 74 to each other, and are also communicated to a fuel well 36 formed around the motor shaft 58.

The impeller 88 is further formed with a plurality of round pressure compensation hollows 66 and 70 on the opposite surfaces of the impeller 88 in the sealing portions 80 and 78. The round hollows 66 and 70 are arranged on a single circle. The round hollows 66 and 70 on the opposite surfaces of the impeller 88 are communicated through a plurality of communication holes 68 to each other. The round hollows 66 and 70 are out of communication with both the vanes 44 and the central groove 72 and 76. Accordingly, the round hollows 66 and 70 are out of communication with the fuel well 36 and the first and second pump chambers 30 and 18.

In operation, when the impellers 88 and 86 are rotated to increase the fuel pressure, the fuel is allowed to flow from the fuel inlet 42 through the first pump chamber 30 and the second pump chamber 18 to the motor chamber 12. However, as the fuel pressure in the fuel well 36 is greater than that in the first pump chamber 30, the fuel tends to flow from the fuel well 36 along the sealing portion 78 or 80 of the impeller 88 to the first pump chamber 30. At this time, because of tare of the impeller 88 or a small error in dimension or installation of the impeller 88, the upper clearance of the sealing portion 80 tends to become greater than the lower clerance thereof. However, as the pressure compensation hollows 66 and 70 are formed on opposite surfaces in the sealing portion 80 and 78, and they are communicated through the communication holes 68 to each other, a pressure differential between the upper clearance and the lower clearance is cancelled to maintain the impeller 88 under a balanced condition. Further, as the fuel in the pressure compensation hollows 66 and 70 functions to lubricate the sealing portion 80 and 78, the impeller 88 may be smoothly rotated with a reduced frictional resistance.

As to the second-stage impeller 86, the fuel pressure in the pump chamber 18 is greater than that in the fuel well 36, and accordingly the fuel tends to flow from the pump chamber 18 along the sealing portion 84 and 82 of the impeller 86 to the fuel well 36. However, similarly to the first-stage impeller 86, since the second-stage impeller 86 is formed with pressure compensation hollows 60 and 64 communicated through communication holes 62 to each other, a pressure differential at the sealing portion 84 and 82 is cancelled to maintain the impeller 86 under a balanced condition.

Figure 10:
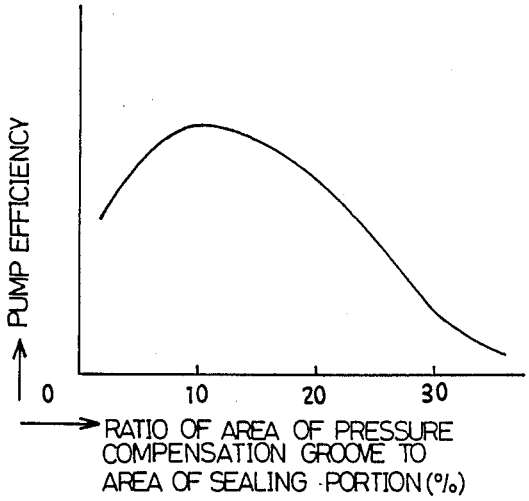
FIG. 10 is a graph showing the relation between a ratio of an area of the pressure compensation hollow to an area of the sealing portion and a pump efficiency according to the present invention.
Figure 11:
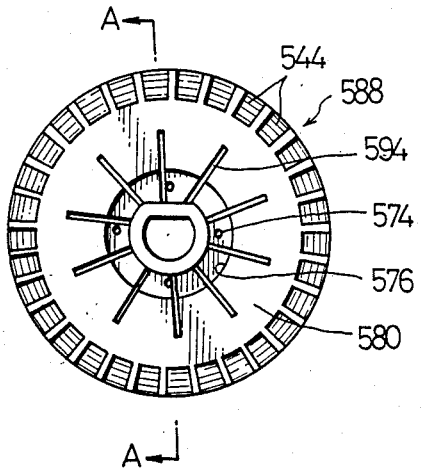
FIG. 11 is a plan view of the first-stage impeller in a sixth embodiment of the present invention.
Figure 12:
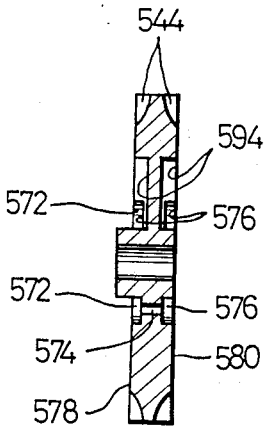
FIG. 12 is a cross section taken along the line A—A in FIG. 11.
Figure 13:
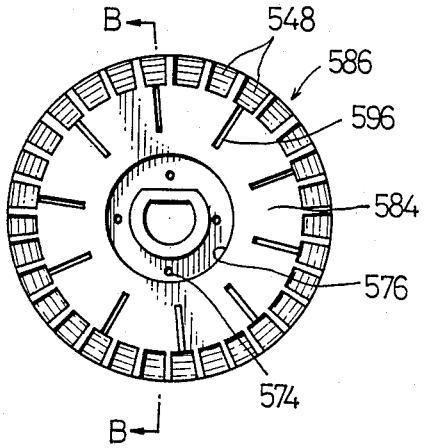
FIG. 13 is a plan view of the second-stage impeller in the sixth embodiment.
Figure 14:
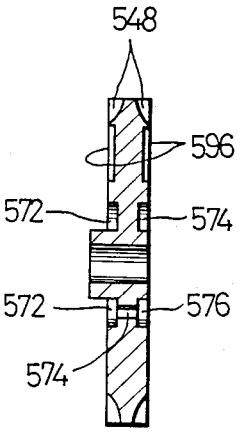
FIG. 14 is a cross section taken along the line B—B in FIG. 13.
Figure 15:
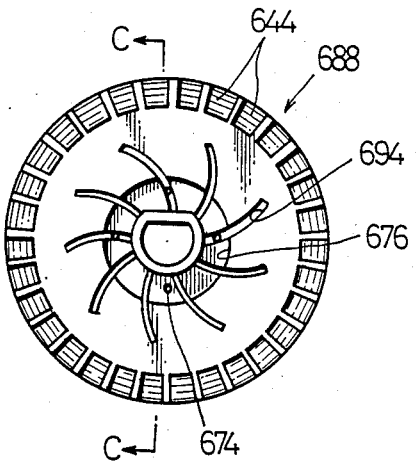
FIG. 15 is a plan view of the first-stage impeller in a seventh embodiment of the present invention.
Figure 16:
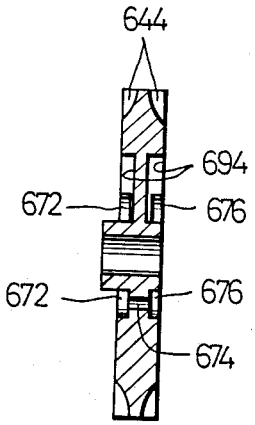
FIG. 16 is a cross section taken along the line C—C in FIG. 15.
Figure 17:
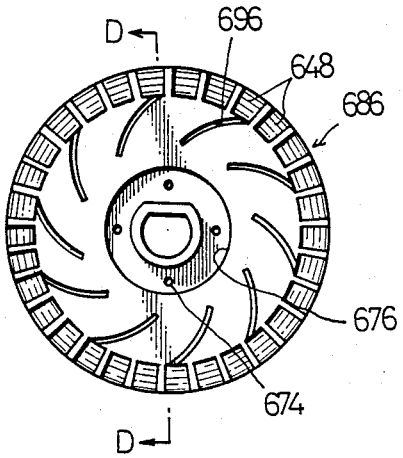
FIG. 17 is a plan view of the second-stage impeller in the seventh embodiment.
Figure 18:
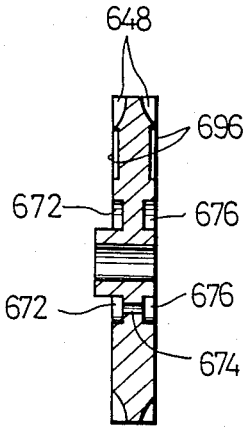
FIG. 18 is a cross section taken along the line D—D in FIG. 17.
Figure 19:
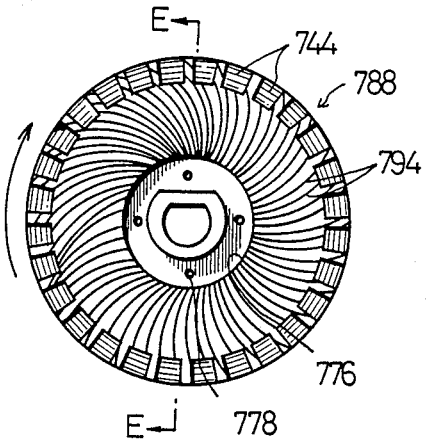
FIG. 19 is a plan view of the first-stage impeller in an eighth embodiment of the present invention.
Figure 20:
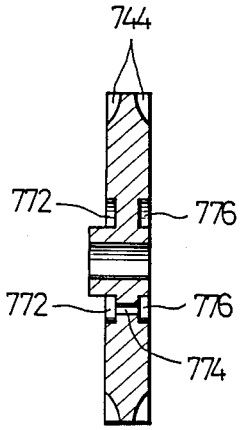
FIG. 20 is a cross section taken along the line E—E in FIG. 19.
Figure 21:
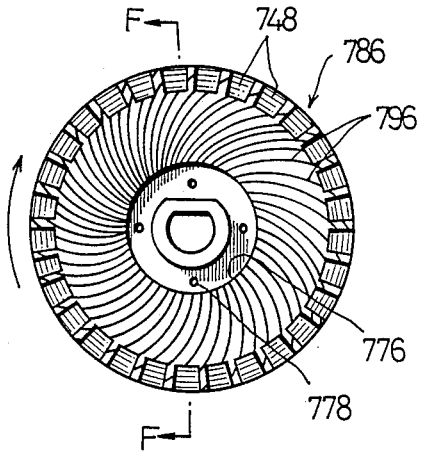
FIG. 21 is a plan view of the second-stage impeller in the eighth embodiment.
Figure 22:
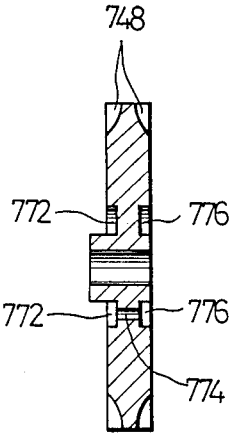
FIG. 22 is a cross section taken along the line F—F in FIG. 21.

Referring to FIG. 10, it is appreciated that the pump efficiency is proper within a specific range of ratio of area of the pressure compensation hollow 60, 64, 66 or 70 to area of the sealing portion 84, 82, 80 or 78. As the result of test, a proper pump efficiency was obtained within the range of ratio of 5–20%. If the ratio is less than 5%, the frictional resistance of the impellers 86 and 88 increases to reduce the pump efficiency. On the other hand, if the ratio is greater than 20%, the frictional resistance decreases, but a leakage loss of fuel increases due to an increased area of the pressure compensation hollows 60, 64, 66 and 70, causing a reduction in the pump efficiency.

Figure 4:
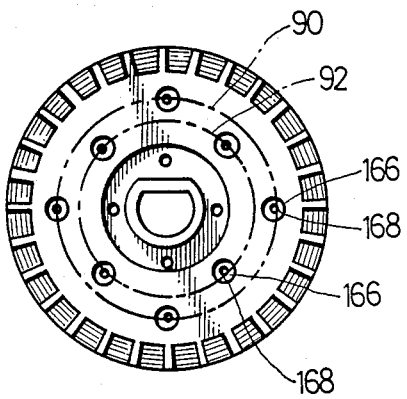
FIGS. 4 and 5 are plan views of second and third embodiments of the impeller according to the present invention.

Referring to FIG. 4 which shows a second preferred embodiment, the pressure compensation hollows 166 are round hollows arranged on two concentric circles 90 and 92 to increase a degree of freedom of the arrangement of the hollows 166.

Figure 5:
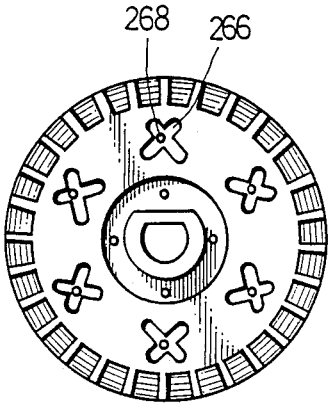

Referring to FIG. 5 which shows a third preferred embodiment, the pressure compensation hollows 266 are cross hollows arranged on a single circle to flow the fuel in multiple directions and thereby enhance the lubricating effect.

Figure 6:
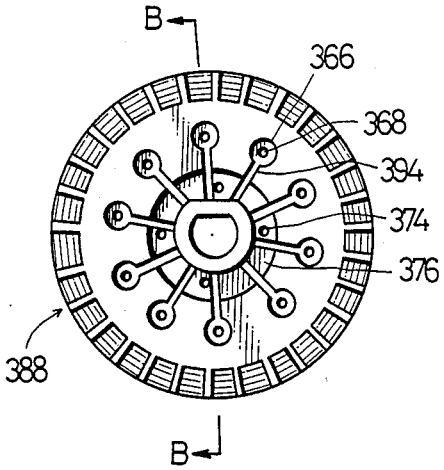
FIG. 6 is a plan view of a fourth embodiment of the impeller according to the present invention.
Figure 7:
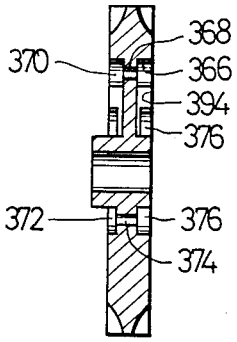
FIG. 7 is a cross section taken along the line B—B in FIG. 6.

Referring to FIGS. 6 and 7 which show a fourth preferred embodiment, there are provided a plurality of communication grooves 394 for communicating the pressure compensation hollows 366 with the central groove 376.

Figure 8:
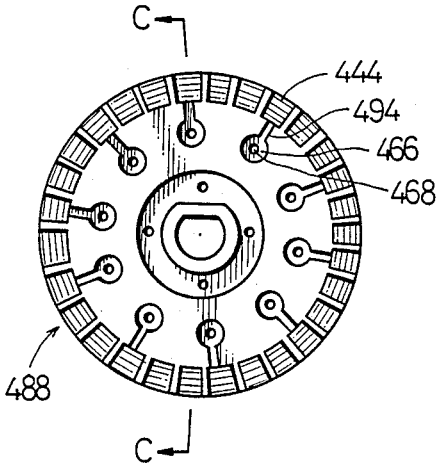
FIG. 8 is a plan view of a fifth embodiment of the impeller according to the present invention.
Figure 9:
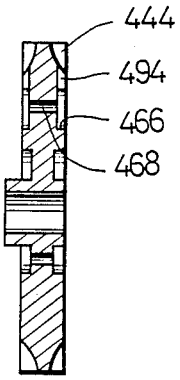
FIG. 9 is a cross section taken along the line C—C in FIG. 8.

Referring to FIGS. 8 and 9 which show a fifth preferred embodiment, there are provided a plurality of communication grooves 494 for communicating the pressure compensation hollows 466 with the vanes 444.

In the fourth and fifth preferred embodiments, the communication grooves 394 and 494 allow the fuel to be easily induced into the pressure compensation hollows 366 or 466, thereby enhancing the balancing effect and the lubricating effect for the impeller 388 or 488.

Referring to FIGS. 11 to 14 which show a sixth preferred embodiment, the first-stage impeller 588 is formed on its opposite surfaces with a plurality of pressure compensation straight grooves 594 communicated with the central grooves 576 and not communicated with the vanes 544. On the other hand, the second-stage impeller 586 is formed on its opposite surfaces with a plurality of pressure compensation grooves 596 communicated with the central groove 576.

In operation, when the first impeller 588 is rotated, the fuel is induced from the fuel well into the pressure compensation grooves 594 of the first impeller 588, and the fuel pressure in the grooves 594 operates to balance the first impeller 588, thus smoothly rotating the first impeller 588. Similarly, the fuel in the second pump chamber is induced into the pressure compensation grooves 596 of the second impeller 586, and the fuel pressure in the grooves 596 operates to balance the second impeller 586, thus smoothly rotating the second impeller 586.

Referring to FIGS. 15 to 18 which show a seventh preferred embodiment, the first-stage impeller 688 is formed on its opposite surfaces with a plurality of pressure compensation curved grooves 694 communicated with the central groove 676 and not communicated with the vanes 644. On the other hand, the second-stage impeller 686 is formed on its opposite surfaces with a plurality of pressure compensation grooves 696 communicated with the vanes 648 and not communicated with the central groove 676. The curved shape of the grooves 694 and 696 contributes to an increase in amount and pressure of the fuel to be induced into the grooves 694 and 696 due to inertia of the fuel moved by the rotation of impellers 688 and 686.

Referring to FIGS. 19 to 22 which show an eighth preferred embodiment, the first-stage and second-stage impellers 788 and 786 are formed at their opposite surfaces with a plurality of pressure compensation grooves 794 and 796, respectively, which are communicated with both the central groove 776 and the vanes 744 and 748. These grooves 794 and 796 are very shallow and are arranged in close relationship to each other.

Figure 23:
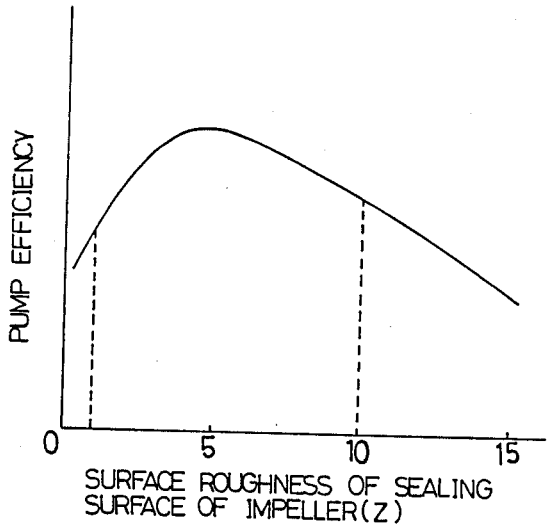
FIG. 23 is a graph showing the relation between a surface roughness of the sealing portion of the impeller and a pump efficiency.

FIG. 23 shows the relation between the pump efficiency and the surface roughness of the sealing surface of the impellers 788 and 786 shown in FIGS. 19 to 22. As is appreciated from FIG. 23, the pump efficiency is satisfactory within the range of the surface roughness of about 1–10 Z (average of ten points). The surface roughness was measured according to JIS B 0601. The grooves 794 and 796 may be provided by utilizing a tool mark generated by a grinding machine. Alternatively, when the impellers are formed of resin, the grooves 794 and 796 are formed by transferring grooves formed on a mold surface. In this embodiment, as the grooves are very shallow, the leakage loss of the fuel may be greatly reduced. Further, as a large number of the grooves 794 and 796 are communicated with both the fuel well and the pump chamber, the amount of fuel to be induced into the grooves may be increased.

Figure 24:
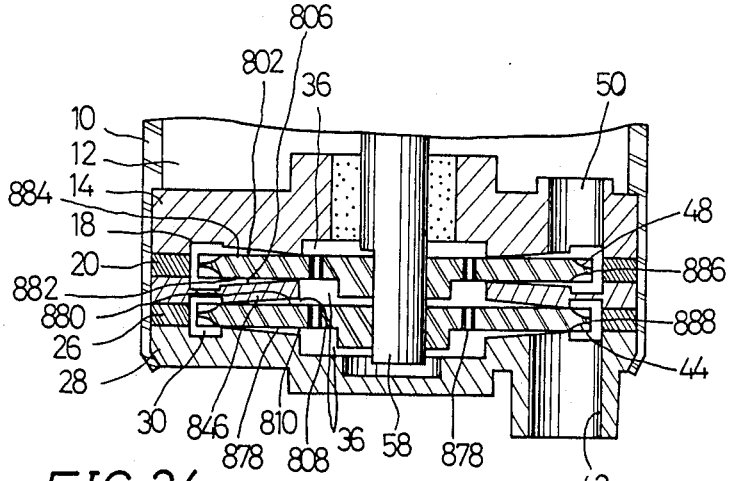
FIG. 24 is a vertical sectional view of the pump section in a ninth embodiment of the present invention.
Figure 25:
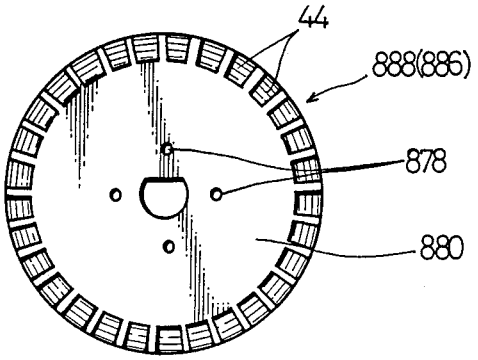
FIG. 25 is a plan view of the impeller shown in FIG. 24.

Referring to FIGS. 24 and 25 which show a ninth preferred embodiment, there are defined clearances 808 and 810 on opposite surfaces of the sealing portion 880 and 878 of the first-stage impeller 888 which clearances have a radially sectional shape diverging toward the fuel well 36. As to the second-stage impeller 886, there are defined clearances 802 and 806 on opposite surfaces of the sealing portion 884 and 882 of the second-stage impeller 886 which clearances have a radially sectional shape diverging toward the pump chamber 18. The clearances 808, 810 and 802, 806 are formed by the inclined upper surface of the end plate 5, the inclined opposite surfaces of the intermediate plate 846 and the inclined lower surface of the partition wall 14 in the sealing portions 884, 882 and 880, 878, respectively.

In operation, when the first-stage impeller 888 is rotated, the fuel is induced from the fuel well 36 into the upper and lower clearances 808 and 810, and the fuel pressure in the upper and lower clearances 808 and 810 operate to balance the first-stage impeller 888, thus smoothly rotating the first-stage impeller 888. Similarly, the fuel in the second pump chamber 18 is induced into the upper and lower clearances 802 and 806 of the second impeller 886, and the fuel pressure in the upper and lower clearances 802 and 806 operates to balance the second-stage impeller 886, thus smoothly rotating the second-stage impeller 886.

Figure 26:
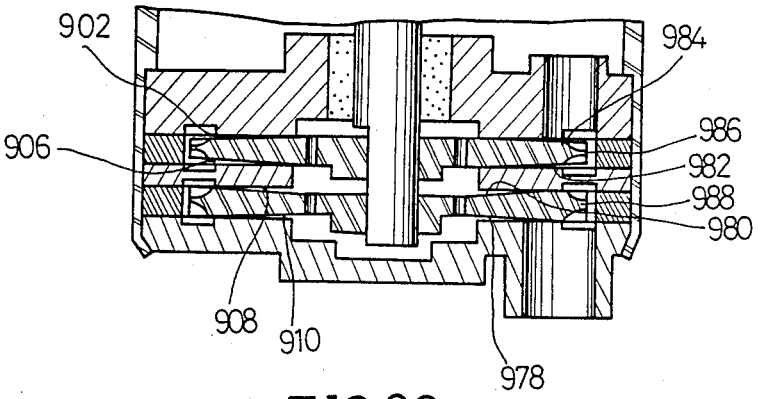
FIG. 26 is a vertical sectional view of the pump section in a tenth embodiment of the present invention.

Referring to FIG. 26 which shows a tenth preferred embodiment similar to the ninth preferred embodiment as mentioned above, the clearances 902, 906, 908 and 910 are formed by obliquely cutting the opposite surfaces in the sealing portions 984, 982, 980 and 978 of the first-stage and second-stage impellers 986 and 988, respectively. The operation is substantially the same as that of the ninth preferred embodiment.

In the ninth and tenth preferred embodiments, the test result proved that the proper inclination of the clearances was about 0.2–5 microns per 1 mm radial length of the sealing surface.

Although the aforementioned preferred embodiments are directed to a two-stage pump, the present invention may be applied to a single stage pump and a three or more stage pump.

What is claimed is:

1. In a motor-driven fuel pump including a motor section provided with a driving motor, and a pump section arranged below said motor section and provided with an impeller to be driven by said driving motor; the improvement comprising a plurality of pressure compensation hollows formed on opposite surfaces in a sealing portion of said impeller, said pressure compensation hollows comprise a plurality of round hollows arranged on concentric circles, and a plurality of communication holes formed through said sealing portion for communicating said pressure compensation hollows.

* * * * *